US005443371A

United States Patent [19]

Calciolari

[11] Patent Number: 5,443,371

[45] Date of Patent: Aug. 22, 1995

[54] NOISE DAMPER FOR HERMETIC COMPRESSORS

[75] Inventor: Leonelo A. Calciolari, Sao Paulo, Brazil

[73] Assignee: Tecumseh Products Company, Tecumsen, Mich.

[21] Appl. No.: 353,826

[22] Filed: Dec. 12, 1994

[51] Int. Cl.[6] ..... F04B 53/00

[52] U.S. Cl. ..... 417/312; 181/403; 181/280

[58] Field of Search ..... 417/312, 902; 181/264, 181/279, 280, 403

[56] References Cited

U.S. PATENT DOCUMENTS

| | | | |
|---|---|---|---|
| 1,341,976 | 6/1929 | Fisher | 181/280 |
| 1,505,893 | 8/1929 | Hunter et al. | 181/253 |
| 1,729,027 | 9/1929 | Brennan | 181/258 |
| 2,359,365 | 10/1944 | Katcher | 181/280 |
| 3,154,245 | 10/1964 | Roelsgaard | 417/312 |
| 3,393,767 | 7/1968 | Monk | 181/280 |
| 3,584,701 | 6/1971 | Freeman | 181/280 |
| 3,746,126 | 7/1973 | de Cardenas | 181/280 |
| 3,947,939 | 4/1976 | Steiner | 416/176 |
| 3,957,133 | 5/1976 | Johnson | 181/60 |
| 4,050,539 | 9/1977 | Kashiwara et al. | 181/280 |
| 4,127,396 | 11/1978 | Tortunici et al. | 55/396 |
| 4,317,502 | 3/1982 | Harris et al. | 181/279 |
| 4,356,591 | 11/1982 | Lude | 417/312 |
| 4,373,354 | 2/1983 | Sawyer | 62/238.6 |
| 4,485,890 | 12/1984 | Harris et al. | 181/280 |
| 4,573,881 | 3/1986 | Romer | 417/312 |
| 4,683,978 | 8/1987 | Venter | 181/280 |
| 4,693,339 | 9/1987 | Beale et al. | 181/255 |
| 4,936,689 | 6/1990 | Federighi | 366/337 |

FOREIGN PATENT DOCUMENTS

| | | | |
|---|---|---|---|
| 23743 | 7/1935 | Australia | 181/67 |
| 1123100 | 9/1956 | France | 181/403 |
| 835599 | 7/1949 | Germany | 181/280 |

*Primary Examiner*—Richard A. Bertsch
*Assistant Examiner*—Peter Korytnyk
*Attorney, Agent, or Firm*—Baker & Daniels

[57] ABSTRACT

A noise suppressor for hermetic compressors comprises a one piece elongate damper element twisted in the form of a helix, with adjustable pitch for the noise frequency band that one wishes to damp. The damper element is designed to be inserted in a gas passage duct of small hermetic refrigeration compressors, for the purpose of reducing the noise emitted by the compressor, by the opening and closing movements of the suction valve and by the flow of refrigerant gas.

9 Claims, 1 Drawing Sheet

NOISE DAMPER FOR HERMETIC COMPRESSORS

BACKGROUND OF THE INVENTION

As is generally known, current hermetic refrigeration compressors, principally with a reciprocating piston, suspended by an elastic means such as mounting springs, and having the suction side connected directly to the frame and the discharge side connected with the exterior by a flexible tube, generally utilize a chamber functioning as a suction muffler, inside of which the gas located inside of the respective frame flows to reach the suction valve or valves.

In the above compressors one of the objectives of the suction muffler is to reduce the transmission of noise generated in general by the opening and closing movements of the suction valve as well as of the respective gas flow that passes through it. For this purpose of reducing the transmission of noise by the suction valves, the muffler is usually provided with internal subchambers and/or labyrinths duly dimensioned in volume and profile for each capacity, displacement, type and application of the compressor, and taking into account the structural details or the manufacturing process.

SUMMARY OF THE INVENTION

The present invention damps suction valve or flow noise by installation of a noise damper in the suction muffler or suction line.

More specifically, the noise suppressor consists of a simple element in the form of a helix inserted longitudinally inside of the passage ducts or lines for the gas that flows to the suction valve or valves, this element acting as a true filter of the noise originating from the suction valve or valves transmitted to the interior of the compressor housing in a direction opposite to the gas flow.

Another object of this suppressor in spiral form is to cause a minimum pressure drop in the gas flow to the suction valve, such that for each frequency band in particular that one wishes to damp, an appropriate alteration is required in the winding pitch of the helix of the damping element.

The present invention also naturally covers innumerable structural alternatives for the element in spiral form, which makes up the noise suppressor in question, and they are related to the materials of its manufacture such as metallic or polymeric strips, as well as referring to its manufacture as an isolated unit or in a single piece integral with the gas passage duct, and also with or without the central nucleus or multiple spirals, but always as a function of each design of suction muffler or of the manufacturing process used for each type of compressor design.

BRIEF DESCRIPTION OF THE DRAWINGS

For a better understanding of the object of the present invention, the attached drawings illustrate a preferred embodiment, but applied by means of example and in a nonlimiting manner to a hermetic compressor of semi-direct suction for refrigeration.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
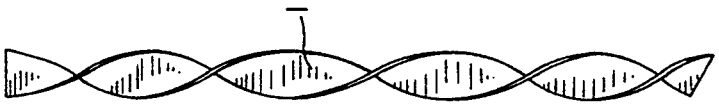
FIG. 2 is an elevational view of the noise suppressor.
Figure 3:
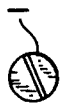
FIG. 3 is an end view of the noise suppressor.

In accordance with the drawing figures, the noise suppressor for hermetic compressors, the object of the present invention, is essentially comprised (FIG. 2) of a one piece damping element 1 twisted in the form of a helix, with an adjustable pitch in the design for the noise frequency band that one wishes to damp. It is designed to be applied in gas passage ducts of small hermetic refrigeration compressors in order to reduce the noise emitted by the compressor, principally for noises generated in the compressor suction area, by the opening and closing movements of the suction valve and by the flow of the gas itself in this area.

Figure 1:
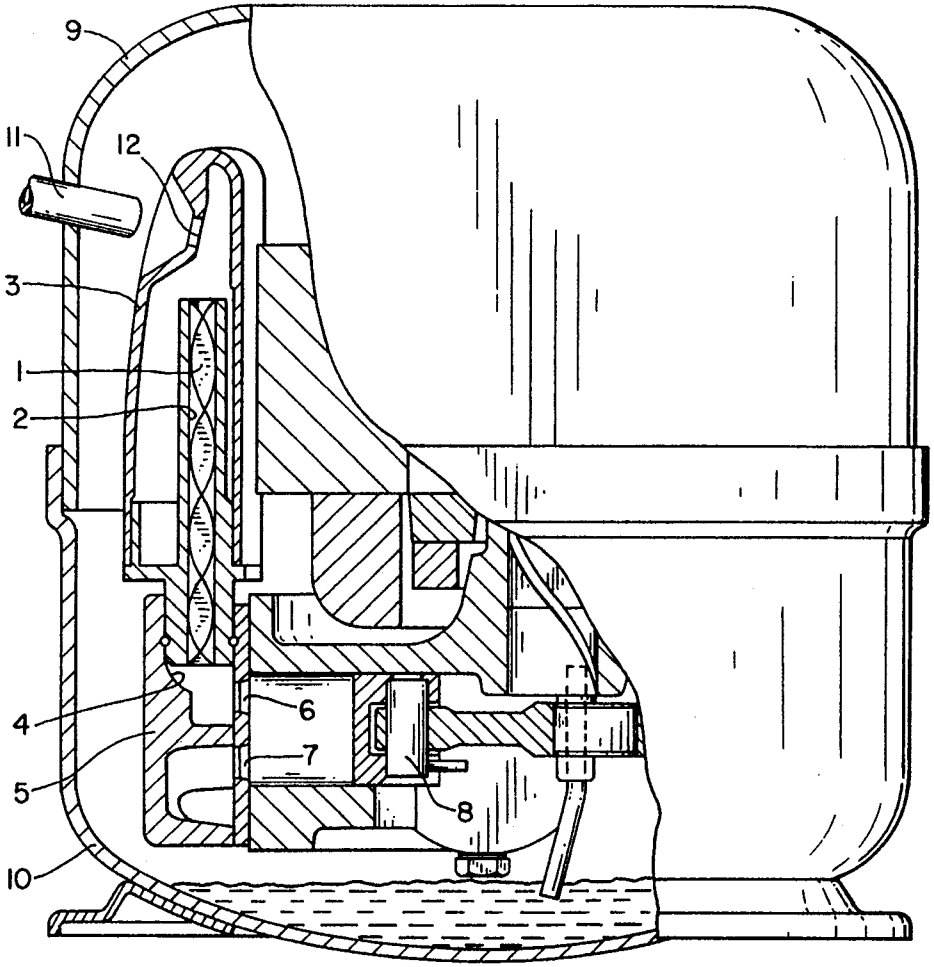
FIG. 1 is a side, partially cut-away view of a hermetic compressor equipped with the noise suppressor according to the present invention.

In the example shown in FIG. 1, in which the noise suppressor of the present invention is applied to a compressor of semi-direct suction, the helical element 1 is arranged longitudinally inside the suction duct 2 in the gas passage from the suction chamber or muffler 3 to the suction cavity 4 of the head 5 of the gas passage valves, suction 6 and discharge 7 respectively, whose opening and closing are effected by the respective piston 8, the entire assembly being closed, together with the other conventional components of the compressor, inside a hermetically sealed housing comprised of two parts, upper housing element 9 and lower element 10, respectively, with the entry of gas through the suction line 11, turned directly toward the entrance 12 of the suction muffler 3.

In the hermetic suction compressor illustrated in FIG. 1, the suction line 11 receives the return gas of the refrigeration system in which the compressor is utilized, directing it to the interior of the hermetic environment contained in housing elements 9, 10, as well as through the respective inlet opening 12, to the inside of the suction muffler 3.

Then, the return movement of piston 8 that controls the valves, when it retracts from the suction valve 6, will obviously cause a pressure differential between the two sides of the valve, this pressure is naturally lower on the side of the piston 8 and higher on the side of the cavity 4 of the head 5, thus inducing the opening of suction valve 6 and providing an outlet for the gas found inside the muffler 3, which is conveyed through the suction duct 2, passing through the noise suppressor 1 and then traversing the suction cavity 4 of the head 5, thus flowing through the suction valve 6 to the compression chamber of the piston 8.

It is noted that during the passage of gas through the suction valve 6 the latter vibrates, opens and closes several times, causing a noise that is propagated principally to the interior of the suction muffler 3 and thence to the inside of the housing elements 9, 10, obviously through the suction duct 2, precisely where the noise suppressor 1 is located and which promotes the attenuation of propagation of this noise generated by the closing and opening of the suction valve 6.

On the other hand, when the piston 8 begins the advance movement for compression, going in the direction of the suction valve 6, a pressure equilibrium occurs between the compression chamber and the cavity 4 of the head 5, after which and with a continued advance movement of the piston there is of course a closing of the suction valve 6 and an opening of the discharge valve 7, the former striking against the respective seat, thus again causing the closing noise, which will have the same propagation route through the suction duct 2, where the noise suppressor 1 is located, as described above.

It is noted that in the attached drawing the noise suppressor 1 is shown as a strip twisted in the form of a helix. It can be of metallic or polymer material such as sheet metal or Vespel or Valox and has a definite pitch, which could of course be altered as needed for attenuating a certain sound frequency; the same can be said with regard to the construction of the helical strip 1, which could be a separate unit or formed in one piece integrally with the respective gas passage duct 2, with or without the central nucleus or core, and also as multiple helices, as a function of each individual suction muffler design or the manufacturing process used for each type of compressor design. An example of a pitch for elimination of a particular sound frequency such as a frequency range from 400 HZ to 630 HZ may be accomplished by a helix having a one rotation through a distance of 1.77 inches. The amount of sound attenuated with this preferred helix is approximately 3 dB when measured when measured on a complete hermetic compressor for refrigerator of approximately 800 BTU/hr as compared to the same compressor without the helix attenuator.

It should be stressed that FIG. 1 of the attached drawings, as well as the description of the functioning, refer to one of the possible applications of the noise suppressor, the object of the present invention, to a compressor of semi-direct suction, without the use of such suppressor being restricted to this type of compressor. On the other hand, it can be extended to any gas passage duct, especially involving suction, of hermetic refrigeration compressors, whether they involve indirect, semi-direct suction, as exemplified, or direct suction.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a housing;

a compressor unit disposed within said housing, said unit including a suction passageway for conveying refrigerant at suction pressure to said compressor unit; and a damper member twisted in the form of a helix disposed within said suction passageway.

2. The compressor of claim 1 in which said damper helix member is adjustable in pitch whereby desired sound frequency ranges are damped by said selective adjustments in damper helix member pitch.

3. The compressor of claim 1 in which said suction passageway is a part of a suction muffler.

4. The compressor of claim 1 in which said damper member is formed of sheet metal.

5. The compressor of claim 1 in which said damper member is formed of polymeric material.

6. The compressor of claim 5 in which said damper helix member is adjustable in pitch whereby desired sound frequency ranges are damped by said selective adjustments in damper helix member pitch.

7. The compressor of claim 5 in which said damper member is formed of sheet metal.

8. A compressor comprising:

a housing;

a compressor unit disposed within said housing, said compressor having a suction valve, said unit including a suction muffler for conveying refrigerant at suction pressure to said suction valve; and an elongate damper member twisted in the form of a helix and disposed within said suction muffler whereby selected sound frequencies created by said suction valve are damped.

9. A compressor comprising:

a housing;

a compressor unit disposed within said housing, said compressor having a suction valve, said unit including a suction muffler for conveying refrigerant at suction pressure to said suction valve; and an elongate damper member twisted in the form of a helix and adjustable in pitch, said damper member disposed within said suction muffler whereby selected sound frequencies created by said suction valve are damped.

* * * * *